United States Patent [19]

Sampei et al.

[11] 4,390,747

[45] Jun. 28, 1983

[54] SPEECH ANALYZER

[75] Inventors: Tohru Sampei; Akihiro Asada; Yoshihiro Ohta; Syunji Iwasaki, all of Yokohama, Japan

[73] Assignee: Hitachi, Ltd., Tokyo, Japan

[21] Appl. No.: 191,294

[22] Filed: Sep. 26, 1980

[30] Foreign Application Priority Data

Sep. 28, 1979 [JP] Japan ..... 54-124055

[51] Int. Cl.[3] ..... G10L 1/00

[52] U.S. Cl. ..... 179/1 SC

[58] Field of Search ..... 179/1 SC, 1 SA, 1 SM; 364/723

[56] References Cited

U.S. PATENT DOCUMENTS 3,715,512 2/1973 Kelly ..... 179/1 SA
4,230,906 10/1980 Davis ..... 179/1 SC
4,303,803 12/1981 Yatsuzuka ..... 179/15.55 R

*Primary Examiner*—Emanuel S. Kemeny
*Attorney, Agent, or Firm*—Antonelli, Terry & Wands

[57] ABSTRACT

A speech analyzer for extracting spectrum information and pitch information from natural speech wherein an accuracy of pitch extraction is enhanced by sampling pitch at a sampling frequency which is higher than a sampling frequency for analyzing the spectrum information.

3 Claims, 5 Drawing Figures

SPEECH ANALYZER

The present invention relates to a speech analyzer for extracting a characteristic of a speech signal from a frequency spectrum of the speech signal.

Frequency components of a speech signal range between approximately 100 Hz and 10 KHz but in the transmission of speech signals the frequency components above 4 KHz may be omitted without a significant problem. The speech signal components ranging from 100 Hz to 4 KHz are sampled, for example, at a sampling frequency of 8 KHz so that a resulting time sequence may represent the speech signal. Since the changes in the spectrum of the speech are due to the movement of tone controlling organs, such as the tongue and the lips, the changes are gentle and they may be regarded as substantially steady when observed over a short period, such as 3–10 milliseconds. Thus, by exactly extracting the characteristic of the voice spectrum from the steady state period, the voice can be analyzed or the voice can be synthesized based on the extracted information. When the speech is to be analyzed or synthesized, parameters representing an envelope of the speech spectrum, parameters representing an amplitude of the speech signal, pitch information corresponding to a fundamental oscillation frequency of the vocal chords and discrimination information for discriminating voiced sounds and unvoiced sounds may be extracted from a voice spectrum of the short time period in which the changes in the voice spectrum can be regarded as steady.

As an analyzing method for coding a speech signal with a high efficiency while eliminating redundancy included in the speech signal, a PARCOR analyzing method which uses a partial auto-correlation coefficient (hereinafter referred to as a PARCOR coefficient) which is a kind of linear prediction coefficient has been known.

This method represents a characteristic parameter of the speech signal by means of the PARCOR coefficient. The speech signal during a short time period in which the changes in the frequency spectrum of the speech signal are gentle and may be regarded as steady is sampled at a sampling frequency of 8 KHz, for example, and samples at two adjacent time points, of the samples in the resulting time sequence are predicted by a minimum square method using samples which exist between those two time points, and the predicted values and actual values at those two points are compared to determine differences therebetween in order to determine a correlation of the differences (PARCOR coefficient). The time difference between the two time points is increased by double, triple and so on and the correlations thereof are determined to obtain parameters representing an envelope of the frequency spectrum of the speech signal. Since the speech signal comprises vocal tract transmission parameters and excitation source parameters, the excitation source parameters must be simultaneously extracted. In a conventional method, the speech signal is sampled by an analog-to-digital (A/D) converter and the correlations of the adjacent samples are sequentially eliminated by a PARCOR analyzer to obtain a signal having a substantially flat spectrum. The resulting signal is analyzed by an excitation source parameter analyzer to produce pitch, power, voiced sound and unvoiced sound information. A sample at a time point in the resulting (residual) signal having the flat spectrum is multiplied by a sample at a time point which is behind by time $\tau$ to determine the correlations, which are sequentially added in an adder. Similar calculation is effected for the samples separated by the time $\tau$. An output signal from the adder is low at time points other than the delay time points of the fundamental period of the voice (hereinafter referred to as the pitch) and has significant peaks at the delay time points corresponding to the fundamental period. From the magnitudes of the peaks the presence or absence of the vocal chord vibration can be determined, and from the positions of the peaks the fundamental period of the voice can be determined.

In this manner the pitch can be extracted. Those operations are carried out for only those samples which are sampled at the sampling frequency. Since the delay time $\tau$ is a multiple of the sampling period, the resulting pitch is an integral multiple of the sampling period. Thus, as an example, when a voice signal having a pitch of 440 Hz is sampled at a sampling frequency of 8 KHz and then the pitch is extracted, the resulting pitch is either 444.4 Hz or 421 Hz and it includes a 1–4.5 percent error. Noting that a semitone of a scale corresponds to six percent, this represents a big error and therefore the conventional method is not adequate for the analyses of songs.

It is an object of the present invention to provide a speech analyzer which overcomes the above difficulties encountered in the prior art system and which can extract a voice pitch with a high accuracy.

The speech analyzer in accordance with the present invention samples the speech signal at a sampling frequency for analyzing spectrum information, interpolates intermediate values of the samples to equivalently obtain n times the number of samples and extracts the pitch from those samples.

One embodiment of the speech analyzer of the present invention is now explained.

Figure 1:
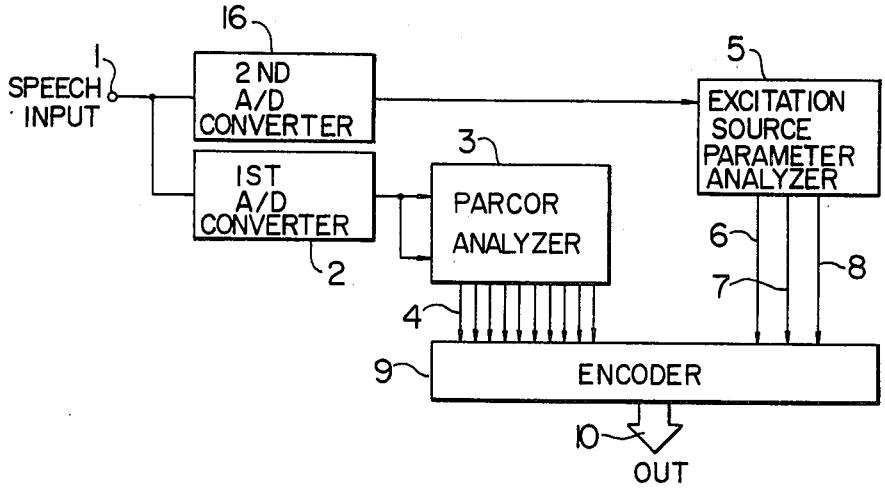
FIG. 1 shows a block diagram of one embodiment of the speech analyzer of the present invention.

Referring to FIG. 1, numeral 1 denotes a speech input terminal, 2 a first A/D converter, 3 a PARCOR analyzer for producing spectrum information of a speech signal, 4 resulting outputs of PARCOR coefficients, 5 an excitation source parameter analyzer, 6 a resulting pitch signal, 7 a power signal, 8 a discrimination signal for voiced sound and unvoiced sound, 9 an encoder, 10 a coded output, and 16 a second A/D converter having a higher sampling frequency than the first A/D converter 2.

The speech signal applied to the input terminal 1 is supplied to the first and second A/D converters 2 and 16. The first A/D converter 2 samples the speech signal at a sampling frequency of 8 KHz, for example, converts the time sequenced samples to digital signals and supplies them to the PARCOR analyzer 3. The PARCOR analyzer 3 determines a partial auto-correlation coefficient of two adjacent samples in the sampled speech signal and supplies the correlation coefficient or the PARCOR coefficient 4 to the encoder 9. The second A/D converter 16 samples the speech signal at a higher sampling frequency than the first A/D converter 2, e.g. at the sampling frequency of 10 KHz. It converts the samples to digital signals and supplies them to the analyzer 5. The analyzer 5 determines a partial auto-correlation of the samples to extract the pitch information 6, the power information 7 and the voiced sound-unvoiced sound discrimination information 8, which are supplied to the encoder 9. The encoder 9 encodes the pitch information 6, the power information 7, the voiced sound-unvoiced sound discrimination information 8 and the PARCOR coefficient 4 to produce the output signal 10 to be transmitted.

Figure 2:
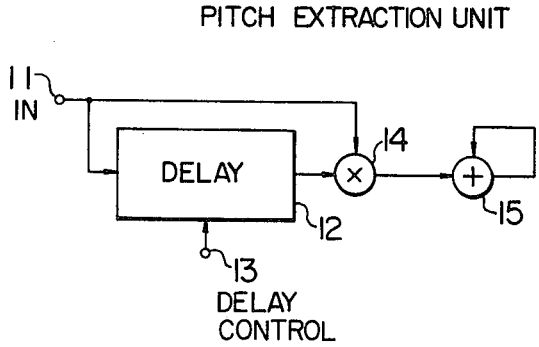
FIG. 2 shows a block diagram of a pitch extracting unit.

FIG. 2 shows the construction of a pitch extraction unit of the excitation source parameter analyzer. The pitch extraction unit determines a self-correlation coefficient of a waveform. Numeral 11 denotes a signal input terminal, 12 a delay line, 13 a delay time control terminal, 14 a multiplier and 15 an adder.

In FIG. 2, a sample of the signal is multiplied with a sample of $\tau$ time behind to calculate the self-correlation and the product is sequentially added in the adder 15. Similar calculation is made on the samples of $\tau$ time behind, respectively. Since the output signal of the adder 15 produces a peak only when the delay time corresponds to the voice pitch, the pitch period can be determined by a time interval between peaks.

Figure 3:
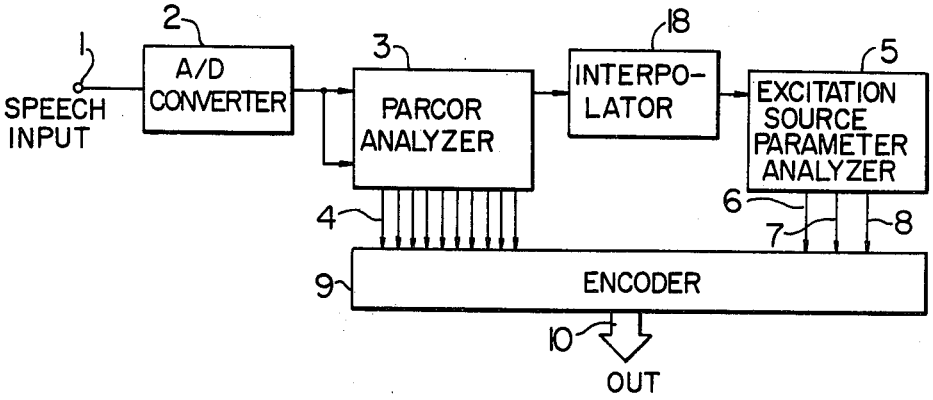
FIG. 3 shows a block diagram of another embodiment of the present invention.

FIG. 3 shows another embodiment of the speech analyzer of the present invention. In the present embodiment, one A/D converter 2 is used. A signal derived from the speech signal by eliminating the PARCOR coefficient by the PARCOR analyzer 3 is fed to the excitation source parameter analyzer 5 through an interpolator 18. The analyzer 5 produces pitch information from the speech signal which is free from the PARCOR coefficient. Since the speech signal supplied to the analyzer 5 is the signal sampled at the sampling frequency of the A/D converter 2, the exact pitch period cannot be detected. In the present embodiment, the speech signal supplied by the PARCOR analyzer 3 is further divided by the interpolator 18 in order to attain an effect similar to that obtainable when the sampling frequency of the A/D converter 2 is raised. A sample generated by the interpolator 18 is inserted between two adjacent samples produced by the A/D converter 2 to enhance the analysis accuracy.

Figure 4:
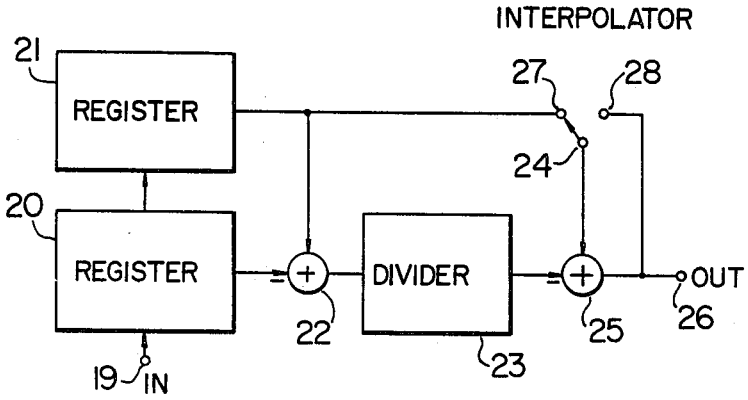
FIG. 4 shows a block diagram of an interpolator.

FIG. 4 shows a construction of the interpolator 18, in which numeral 19 denotes an input terminal for the speech signal supplied from the analyzer 3, numerals 20 and 21 denote registers, 22 an adder, 23 a divider which may be a divide-by-eight divider when interpolation is to be made at one-eighth interval, 24 a switch, 25 an adder and 26 an output terminal.

The speech signal is first applied to the register 20, thence it is shifted to the register 21 one sampling time period later. Accordingly, the register 21 stores a previous sample while the register 20 stores a current sample.

Figure 5:
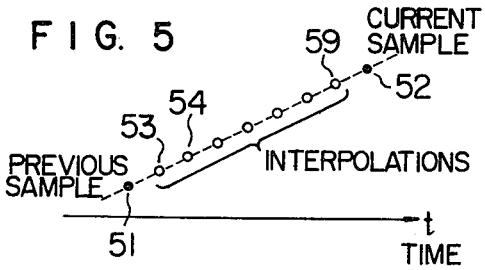
FIG. 5 illustrates a manner of interpolation operation.

The current sample stored in the register 20 and the previous sample stored in the register 21 are supplied to the adder 22 in opposite phase to each other. In the present embodiment, the phase of the output signal of the register 20 is inverted and then applied to the adder 22. As a result, the adder 22 carries out a subtraction operation so that a difference between the previous sample and the current sample is determined. The resulting difference output signal is fed to the divider 23 which divides the difference by the factor of eight. The switch 24 connected to the adder 25 initially selects the terminal 27 so that the previous sample in the register 21 is fed to the adder 25 through the switch 24. The signal divided by the factor of eight by the divider 23 is phase-inverted and then applied to the adder 25 where it is added to the previous sample from the register 21 and the resulting sum is produced at the output terminal 26. The resulting signal is an interpolation signal 53 shown in FIG. 5. A signal 51 represents the previous sample and a signal 52 represents the current sample stored in the register 20. After the interpolation value 53 has been produced, the switch 24 is connected to select the terminal 28 so that the output signal of the divider 23 is added to the interpolation value 53. The resulting sum output signal appears at the output terminal 26. It is an interpolation signal 54.

In this manner, the space interval between the samples 51 and 52 sampled by the A/D converter 2 is filled up with the interpolation values 53, 54, . . . , 59 so that the extraction accuracy of the pitch information is enhanced.

In this manner the effective sampling frequency can be increased to enhance the pitch accuracy.

What is claimed is:

1. A speech analyzer comprising:

(a) analog-to-digital converter means for receiving and sampling a natural speech signal;

(b) spectrum analyzer means responsive to an output signal of said analog-to-digital converter means for producing spectrum information of said natural speech signal and an output signal in which said spectrum information is eliminated from said natural speech signal;

(c) interpolator responsive to said output signal of said analog-to-digital converter means for interpolating intermediate values between adjacent samples and for producing an output signal representative thereof; and (d) excitation source parameter analyzer means responsive to the output signal of said interpolator means for producing a pitch information signal indicating the pitch of said natural speech signal.

2. A speech analyzer comprising:

(a) first analog-to-digital converter means for sampling a received speech signal at a first sampling frequency;

(b) partial auto-correlation coefficient analyzer means responsive to the sampled speech signal from said first analog-to-digital converter means for determining a PARCOR coefficient of two adjacent samples in said sampled speech signal;

(c) second analog-to-digital converter means for sampling the received speech signal at a second sampling frequency higher than said first sampling frequency of said first analog-to-digital converter means; and (d) excitation source parameter analyzer means responsive to the sampled speech signal from said second analog-to-digital converter means for determining the partial auto-correlation of samples in the sampled speech signal to produce pitch information of said speech signal.

3. A speech analyzer comprising:

(a) analog-to-digital converter means connected to receive a natural speech signal of a short time period for sampling said natural speech signal at a predetermined sampling frequency to provide a plurality of signal samples and convert each of said plurality of signal samples into a digital signal;

(b) spectrum analyzer means responsive to the output signal of said analog-to-digital converter means for extracting spectrum information of said natural speech signal;

(c) excitation source parameter analyzer means for extracting pitch information of said natural speech signal;

(d) signal supplying means for converting said natural speech signal into further digitized signal samples greater in number than the number of signal samples produced by said digital-to-analog converter means and for supplying said further samples to said excitation source parameter analyzer means, said excitation source parameter analyzer means including means for extracting pitch information, power information and identification information of said natural speech signal from the output of said signal supplying means; and (e) encoder means for encoding said spectrum information extracted by said spectrum analyzer means and said pitch information, said power information and said identification information extracted by said excitation source parameter analyzer means.

* * * * *